US010641519B1

(12) United States Patent
Freedman

(10) Patent No.: US 10,641,519 B1
(45) Date of Patent: May 5, 2020

(54) AESTHETIC ALTERING ENCLOSURE FOR A DUCTLESS, WALL-MOUNTED AIR CONDITIONER

(71) Applicant: Curt M. Freedman, Longmeadow, MA (US)

(72) Inventor: Curt M. Freedman, Longmeadow, MA (US)

( * ) Notice: Subject to any disclaimer, the term of this patent is extended or adjusted under 35 U.S.C. 154(b) by 354 days.

(21) Appl. No.: 15/492,233

(22) Filed: Apr. 20, 2017

Related U.S. Application Data

(60) Provisional application No. 62/325,047, filed on Apr. 20, 2016.

(51) Int. Cl.
*F24F 13/20* (2006.01)
*F24F 13/08* (2006.01)

(52) U.S. Cl.
CPC ..... *F24F 13/20* (2013.01); *F24F 13/08* (2013.01); *F24F 2221/17* (2013.01)

(58) Field of Classification Search
CPC ..... F24F 13/08; F24F 13/20; F24F 2221/17
USPC ..... 454/277
See application file for complete search history.

(56) References Cited

U.S. PATENT DOCUMENTS

| | | | | |
|---|---|---|---|---|
| 4,325,594 | A * | 4/1982 | Lang | F24F 13/20 174/542 |
| 6,497,463 | B2 * | 12/2002 | Moretti | F24F 13/20 312/236 |
| D468,418 | S * | 1/2003 | Ilicic | D23/395 |
| D736,363 | S * | 8/2015 | Pereira | D23/354 |
| 2007/0011930 | A1 * | 1/2007 | Yarmosh | A47G 5/00 40/725 |
| 2007/0221302 | A1 * | 9/2007 | Boone | F24F 1/027 150/165 |
| 2008/0108294 | A1 * | 5/2008 | Reed | F24F 13/20 454/202 |
| 2010/0024459 | A1 * | 2/2010 | Dillon | F24F 1/0007 62/259.1 |

* cited by examiner

*Primary Examiner* — Edelmira Bosques
*Assistant Examiner* — Dana K Tighe
(74) *Attorney, Agent, or Firm* — Malcolm J. Chisholm, Jr.

(57) ABSTRACT

The enclosure (50) has an aesthetic panel (52) extending between sidewalls (56, 60). The enclosure (50) is configured to be detachably secured directly over a wall-mounted air conditioner (40) without impeding air flow through the air conditioner (40) and without impeding air conditioner controls (48, 49). A wall mounting system (100) provides for hinged pivoting of the enclosure (50) away from the air conditioner (40) for servicing the air conditioner (40), and for maintaining the enclosure (50) in unchanging, proper alignment by having a top side wall brace (63) of the enclosure (50) rest upon a docking catch (144) of the wall mounting system (100). The aesthetic panel (52) and side walls (51, 60) may have a variable wood grain appearance or be made of solid wood.

7 Claims, 7 Drawing Sheets

AESTHETIC ALTERING ENCLOSURE FOR A DUCTLESS, WALL-MOUNTED AIR CONDITIONER

CROSS-REFERENCE TO RELATED APPLICATIONS

This application claims the benefit of U.S. Provisional Application No. 62/325,047 that was filed on 20 Apr. 2016 and which Provisional Patent Application was entitled "AESTHETIC ALTERING ENCLOSURE FOR A DUCTLESS, WALL-MOUNTED AIR CONDITIONER", and which is also incorporated herein by reference.

TECHNICAL FIELD

This disclosure relates to an enclosure for altering an aesthetic or appearance of a wall-mounted ductless air conditioner. The enclosure may be retro-fit around wall-mounted, ductless air conditioners to coordinate an aesthetic of a mounting wall and room with the aesthetic of the enclosure without disrupting performance of the wall-mounted air conditioner.

BACKGROUND ART

It is well known that modern heating, ventilating and air conditioning ("HVAC") systems (hereinafter collectively referred to as air conditioners for convenience) have improved cooling and heating efficiencies by separating a compressor section of a traditional "window-mounted" air conditioner from a heat exchanger section. This involves placing a compressor and/or heat pump outside of a structure, such a residence or any building, cycling a refrigerant into a heat exchanger within the building to remove or add heat, and then sending the refrigerant back outside of the building to the compressor to repeat the cycle. The heat exchangers are typically wall mounted, and because the compressor section is not in the building, the mounted heat exchanger may be operated very quietly, and may remove or all much more heat than a typical window mounted air conditioner. Additionally, unlike a central air conditioner system that cycles air throughout a building in dusty ducts, the modern, split compressor-heat exchanger systems only use much smaller, sealed, pressurized, refrigerant transport lines. Therefore the popularity and efficiencies of ductless, wall-mounted air conditioners is growing world-wide.

Unfortunately, however, the wall-mounted air conditioners are typically mass produced and are only available in a single color, typically a shade of white. Moreover, to be efficient, the wall-mounted heat exchangers must be located in plain sight, such as on a main wall, and near a top of the wall for effective circulation of air passing through the air conditioners. Hence, for many consumers, the wall-mounted air conditioners are a literal eye-sore, and cause a substantial disruption of an aesthetic appeal of the room in which they are mounted.

Accordingly, there is a need for a wall-mounted air conditioner enclosure that alters an aesthetic or appearance of the air conditioner thereby overcoming deficiencies of the prior art.

SUMMARY OF THE DISCLOSURE

The disclosure is an aesthetic altering enclosure for a ductless, wall-mounted air conditioner. The enclosure includes a rectangular-shaped aesthetic panel extending between a front edge of a first side wall and a front edge of an opposed second side wall, wherein the side walls are about parallel to each other and extend away from a back side of the aesthetic panel. A top side wall brace extends between a back top corner of the first side wall to a back top corner of the second side wall. A bottom side wall brace extends between a back bottom corner of the first side wall to a back bottom corner of the second side wall. A void is defined between the side walls, the top side wall brace, the bottom side wall brace, and the back side of the aesthetic panel. An uninterrupted top air inlet into the void is defined between a top edge of the aesthetic panel and top edges of the opposed side walls and the top side wall brace. The aesthetic panel also defines a display surface overlying a front surface of the panel.

A curvilinear bottom section of the aesthetic panel corresponds with curvilinear bottom sections of the opposed side walls, so that front edges of the side walls curve away from the aesthetic panel in a direction away from the back side of the aesthetic panel toward the side-wall brace-strut. The curvilinear bottom section of the aesthetic panel includes a plurality of louvres that extend in parallel association between the opposed, curvilinear sections adjacent the front edges of the opposed side walls. The louvres are spaced apart from each other to define a plurality of separate void passages between the louvres. In particular, the plurality of void passages are dimensioned so that between about thirty percent and about seventy percent of the area of the curvilinear section of the aesthetic panel is void to define a bottom air outlet of the enclosure.

The top air inlet of the enclosure overlies an air inlet of the air conditioner and the bottom air outlet of the enclosure overlies an air outlet of the air conditioner. Also, the aesthetic panel is dimensioned to cover between about eighty and about ninety percent of an exterior front surface of the air conditioner. The enclosure is also configured so that air flow into and out of the air conditioner is unimpeded by the enclosure. Additionally, signals from an air conditioner remote control pass into the air conditioner through the bottom air outlet, unimpeded by the enclosure.

In another and alternative embodiment, the aesthetic altering enclosure for a ductless, wall-mounted air conditioner also includes a distinct wall-mounting system that is pivotally secured to the enclosure. The wall-mounting system includes a horizontal mounting bar that is configured to be securely attached to the vertical wall. The mounting bar has a back side adjacent the wall and an opposed front side. The front side includes a first edge plate secured to the front side adjacent a first end of the bar. A first plate-lip of the first edge plate extends above a top edge and the front face of the mounting bar. The mounting bar also includes a second edge plate secured to the front side adjacent a second end of the bar, opposed to the first end of the bar. The second edge plate includes a second plate-lip extending above the top edge and the front face of the mounting bar.

The wall mounting system also includes a notched frame that is constructed to define a rectangular opening dimensioned to surround the wall-mounted air conditioner and be positioned adjacent the air conditioner while being secured to the wall surrounding the air conditioner. A top bar of the notched frame includes a first notch-sleeve that is defined and configured to receive and secure the first plate-lip within the first notch-sleeve. The top bar also defines a second notch-sleeve that is configured to receive and secure the second plate-lip within the second notch-sleeve. At least one hinge is secured to the notched frame and to a back edge of either the first or second side wall of the enclosure. The hinged enclosure can then pivot about the hinge from being adjacent the notched frame and enclosing the air conditioner to being away from and no longer enclosing the air conditioner for servicing the air conditioner.

In another and alternative embodiment, the aesthetic altering enclosure for a ductless, wall-mounted air conditioner includes a docking arm secured to the notched frame between the frame and the air conditioner at a position on the notched frame opposite to the position of the at least one hinge between the enclosure and the notched frame. The docking arm extends away from the wall a distance beyond a front face of the notched frame. The docking arm includes an upper surface having a docking catch positioned in the upper surface. The docking catch is configured to engage an enclosure catch within a bottom surface of the top side wall brace of the enclosure. The docking catch is positioned adjacent one of the first and second side walls. The top side wall brace is configured to overlie and rest upon the upper surface of the docking arm when the docking catch engages the enclosure catch. The docking arm thereby prevents any sagging of the enclosure on the hinge away from a proper alignment with the notched frame and enclosed air conditioner.

In yet another and alternative embodiment of the aesthetic altering enclosure, the docking catch is either a rounded protrusion or a rounded depression. Similarly, the enclosure catch is either a rounded depression or a rounded protrusion. The rounded protrusion or depression of the docking catch is configured to mate with the rounded protrusion or depression of the enclosure catch to thereby provide limited resistance to movement of the enclosure catch away from the docking catch. It is to be understood that while the rounded protrusions and depressions provide limited resistance for pivoting open the enclosure, the docking and enclosure catches may also be any catch means for temporarily securing the enclosure to the docking arm, such as a sliding bar latch, a hook and eye fastener, and any catch or latch mechanisms known in the art that can accomplish the described function.

In yet another and alternative embodiment of the aesthetic altering enclosure, the display surface of the aesthetic panel displays a wood-grain appearance, and the first and second side walls also display wood-grain surfaces.

In another alternative embodiment of the aesthetic altering enclosure, the aesthetic panel, the first and second side walls, and the louvres are made of solid wood.

The present aesthetic altering enclosure for a ductless, wall-mounted air conditioner overcomes deficiencies of the prior art and provides an attractive, efficient enclosure that enhances an appearance of any room having a wall-mounted air conditioner.

PREFERRED EMBODIMENTS OF THE DISCLOSURE

Figure 1:
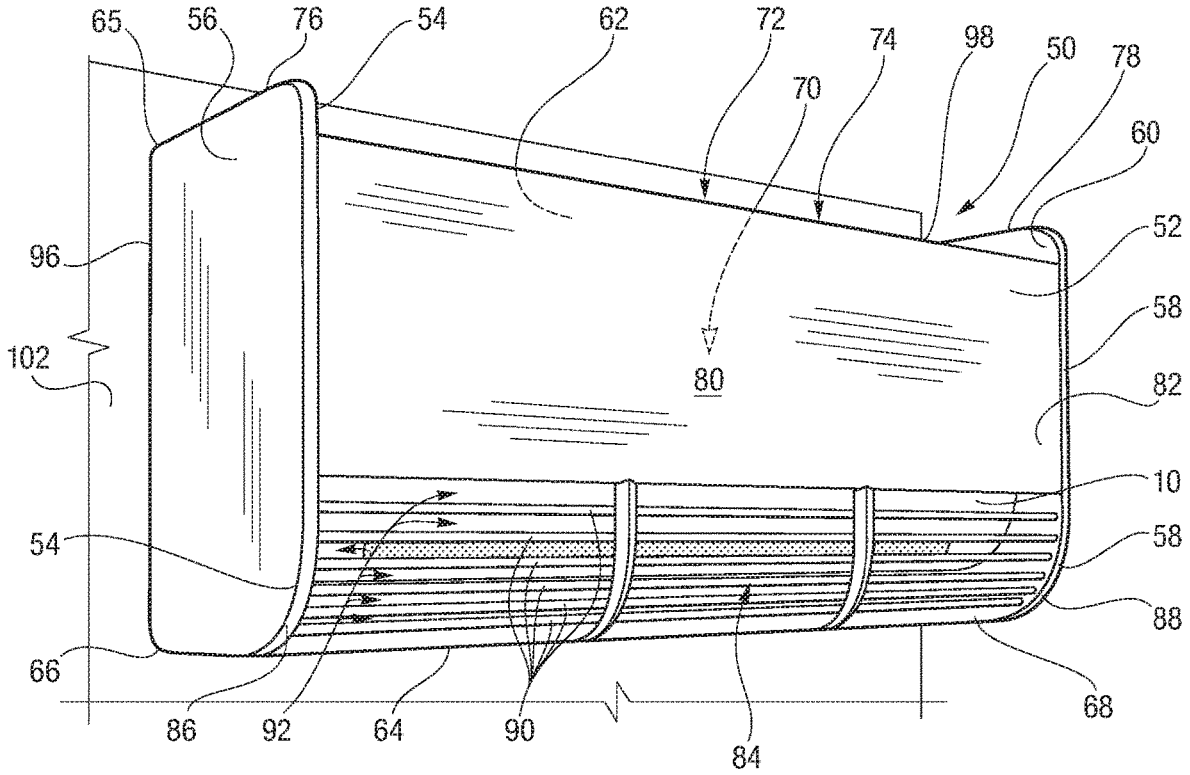
FIG. 1 is a side perspective view of an aesthetic altering enclosure for a ductless, wall-mounted air conditioner constructed in accordance with the present invention, and showing the enclosure surrounding and enclosing a ductless, wall-mounted air conditioner.
Figure 4:
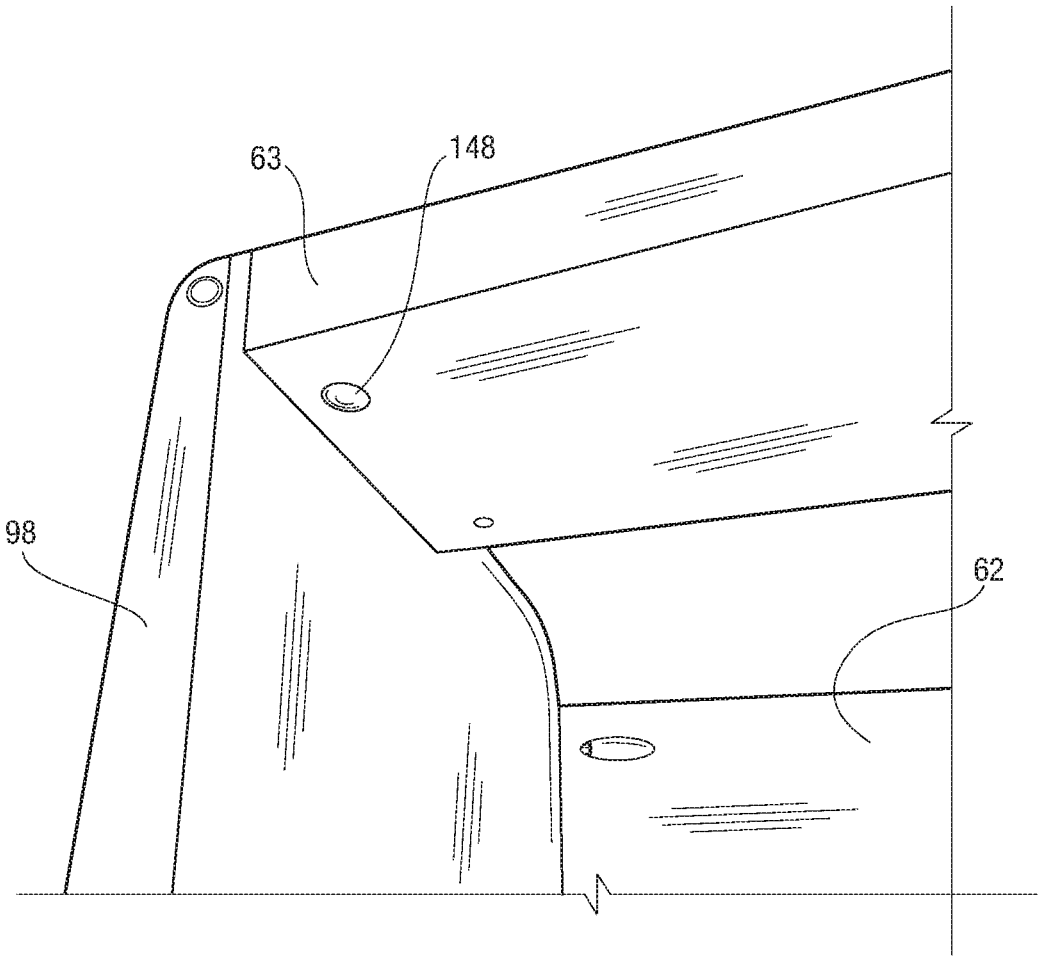
FIG. 4 is a bottom perspective view of an enclosure catch defined in a bottom surface of a top side wall brace of the enclosure.

Referring to the drawings in detail an aesthetic altering enclosure for a ductless, wall-mounted air conditioner 40 is shown best in FIG. 1 and the enclosure is generally designated by the reference numeral 50. The enclosure 50 includes a rectangular-shaped aesthetic panel 52 extending between a front edge 54 of a first side wall 56 and a front edge 58 of an opposed second side wall 60, wherein the side walls 56, 60 are about parallel to each other and extend away from a back side 62 (shown also in FIG. 4) of the aesthetic panel 52. A top side wall brace 63 extends between a back top corner 65 of the first side wall to a back top corner 67 of the second side wall 60. (Shown best in FIGS. 6 and 7.) A bottom side wall brace 64 extends between a back bottom corner 66 of the first side wall 56 to a back bottom corner 68 of the second side wall 60 (shown also in FIG. 7). A void 70 is defined between the side walls 56, 60, the top side wall brace 63, the bottom the side wall brace 64, and the back side 62 of the aesthetic panel 52. An uninterrupted top air inlet 72 (shown best in FIG. 6) into the void 70 is defined between a top edge 74 of the aesthetic panel 52, a top edge 76 of the first side wall 56, and a top edge 78 of the second side wall 60. The aesthetic panel 52 also defines a display surface 80 overlying a front surface 82 of the panel (seen best if FIGS. 1 and 6).

A curvilinear bottom section 84 of the aesthetic panel 52 corresponds with a curvilinear bottom section 86 of the first side wall 56 and a curvilinear bottom section 88 for the second side wall 60, so that a front edge 54 of the first side wall 56 and a front edge 58 of the second side wall 60 curve away from the aesthetic panel 52 in a direction away from the back side 62 of the aesthetic panel 52 toward the side-wall brace-strut 64. The curvilinear bottom section 84 of the aesthetic panel 52 includes a plurality of louvres 90 that extend in parallel association between the opposed, curvilinear sections 86, 88 adjacent the front edges 54, 58 of the opposed side walls 56, 60. The louvres 90 are spaced apart from each other to define a plurality of separate void passages 92 between the louvres 90. In particular, the plurality of void passages 92 are dimensioned so that between about thirty percent and about seventy percent of an area of the curvilinear bottom section 84 of the aesthetic panel 52 is void to define a bottom air outlet 92 of the enclosure 50.

Figure 2:
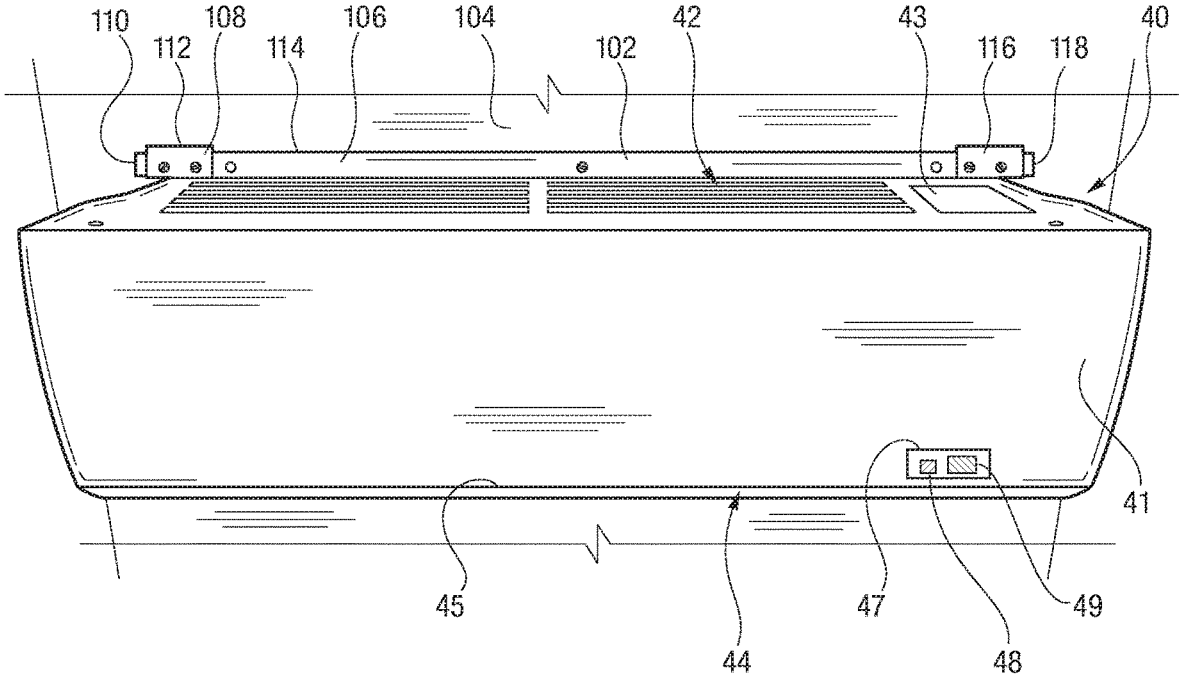
FIG. 2 is a front view of a wall-mounted air conditioner showing a mounting bar of a wall-mounting system for the aesthetic altering enclosure for a ductless, wall-mounted air conditioner.

FIG. 2 shows a prior art standard ductless, wall-mounted air conditioner 40 that includes a front surface 41 extending between an air inlet 42 at a top 43 of the air conditioner 40 and an air outlet 44 at a bottom 45 of the air conditioner 40. The wall-mounted air conditioner 40 also includes a moveable deflector bar 46 (shown only in FIG. 7) that moves during operation of the air conditioner 40 to deflect outflowing, cool air to differing locations so that a room (not shown) cooled by the air conditioner 40 receives cooled air in varying dispersion patterns. The air conditioner 40 may also include a control panel 47 that may include only manually operational controls 48 or a receiver 49 for a remote control (not shown).

As best shown in FIGS. 2-7, the aesthetic altering enclosure 50 for the ductless, wall-mounted air conditioner 40 also includes a distinct wall-mounting system 100 that is pivotally secured to the enclosure 50. The wall-mounting system 100 includes a horizontal mounting bar 102 (shown best in FIGS. 2 and 3) that is configured to be securely attached to the vertical wall 104, such as screwed into vertical wall studs (not shown) behind the wall 104 to thereby support and transfer most of the weight load of the mounting system 100 and the enclosure 50 through the mounting bar 102 to the wall studs. The mounting bar 102 has a back side (not shown) adjacent the wall 104 and an opposed front side 106. The front side 106 includes a first edge plate 108 secured to the front side 106 adjacent a first end 110 of the bar. A first plate-lip 112 of the first edge plate 108 extends above a top edge 114 and above the front side 106 of the mounting bar 102. The mounting bar 102 also includes a second edge plate 116 secured to the front side 106 adjacent a second end 118 of the bar 102, opposed to the first end 110 of the bar 102. The second edge plate 116 includes a second plate-lip 120 extending above the top edge 114 and the front side 106 of the mounting bar 102.

Figure 3:
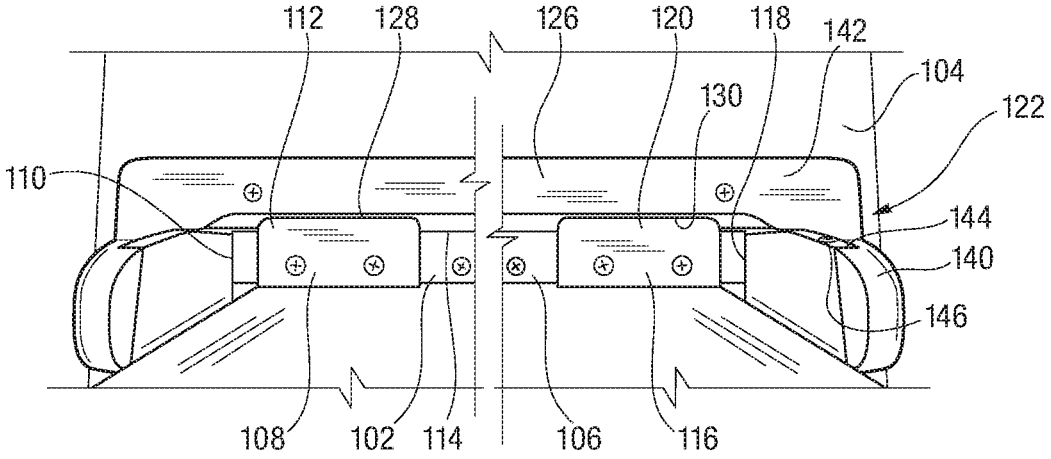
FIG. 3 is a fragmented front view showing a top bar of a notched frame having notch-sleeves receiving plate-lips of a mounting bar, and showing a docking arm secured between the notched frame and the air conditioner and showing a docking catch defined within an upper surface of the docking arm.

As shown in FIG. 3, the wall mounting system 100 also includes a notched frame 122 that is constructed to define a rectangular opening 124 dimensioned to surround the wall-mounted air conditioner 40 and be positioned adjacent and surrounding the air conditioner 40 while being secured to the vertical wall 104. A top bar 126 (shown best in FIG. 3 and in FIGS. 6 and 7) of the notched frame 122 includes a first notch-sleeve 128 that is defined and configured to receive and secure the first plate-lip 112 within the first notch-sleeve 128. The top bar 126 also defines a second notch-sleeve 130 that is configured to receive and secure the second plate-lip 120 within the second notch-sleeve 130.

Figure 6:
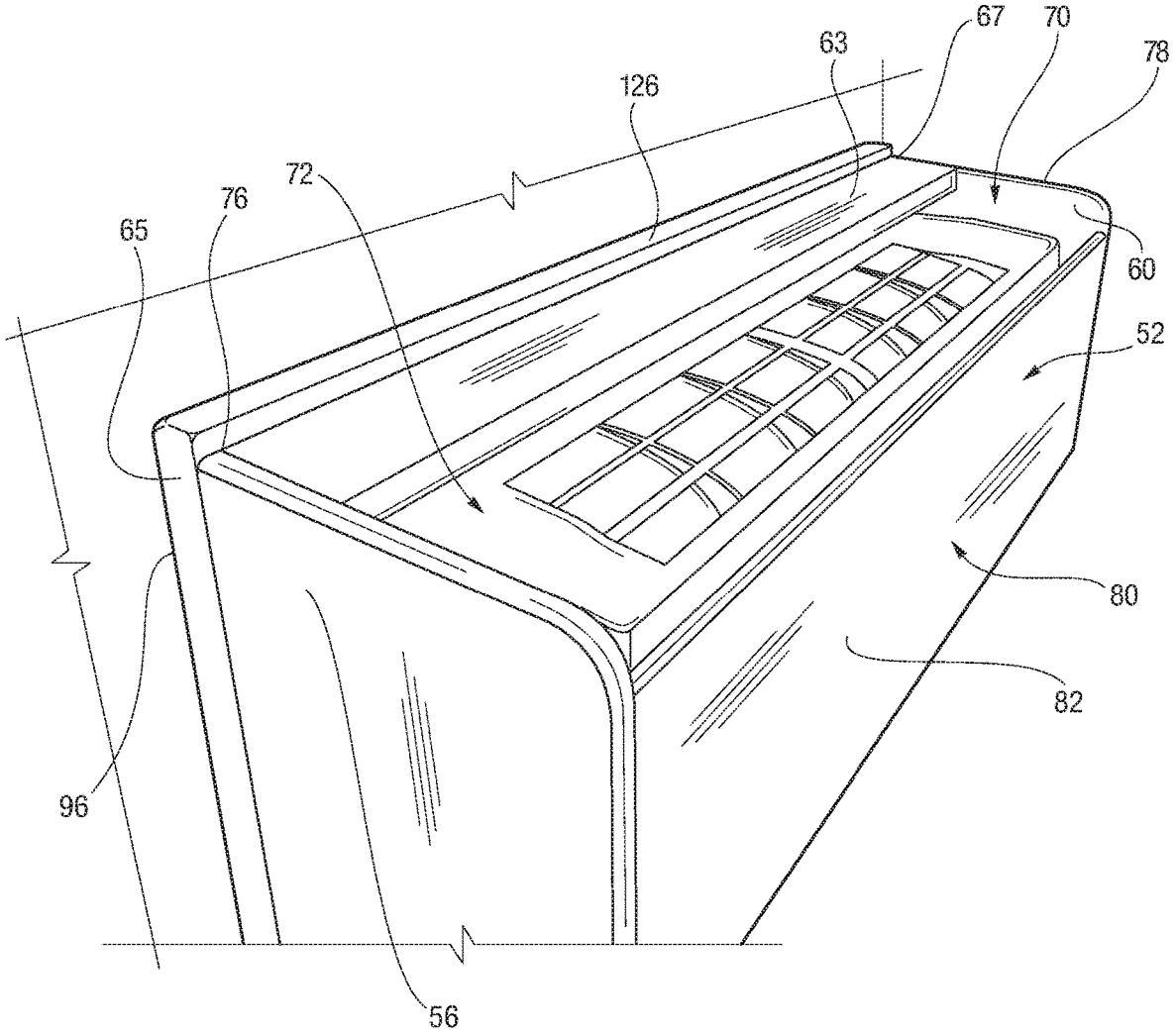
FIG. 6 is a top perspective view of the aesthetic altering enclosure for a ductless, wall-mounted air conditioner hinged to a wall mount system for the enclosure and showing the enclosure hinged closed to enclose the air conditioner.
Figure 7:
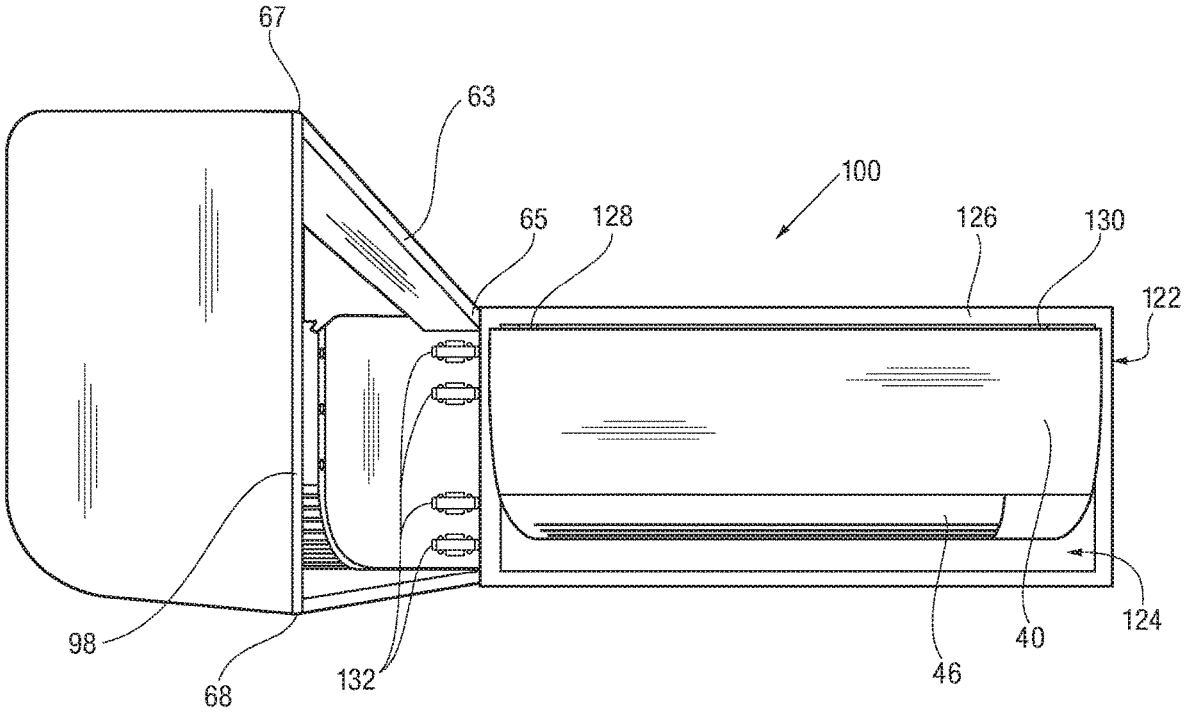
FIG. 7 is a front perspective view of the aesthetic altering enclosure for a ductless, wall-mounted air conditioner hinged to a wall mount system for the enclosure and showing the enclosure hinged open to permit servicing of the air conditioner.

At least one hinge 132 (shown in FIG. 7) is secured to the notched frame 122 and to a back edge 96 of the first side wall 56 or the back edge 98 of the second side wall 60 of the enclosure 50. The hinged enclosure 50 can then pivot about the hinge 132 from being adjacent the notched frame 122 and enclosing the air conditioner 40 (as shown in FIG. 6) to being away from and no longer enclosing the air conditioner 40 for servicing the air conditioner 40 (as shown in FIG. 7).

Figure 5:
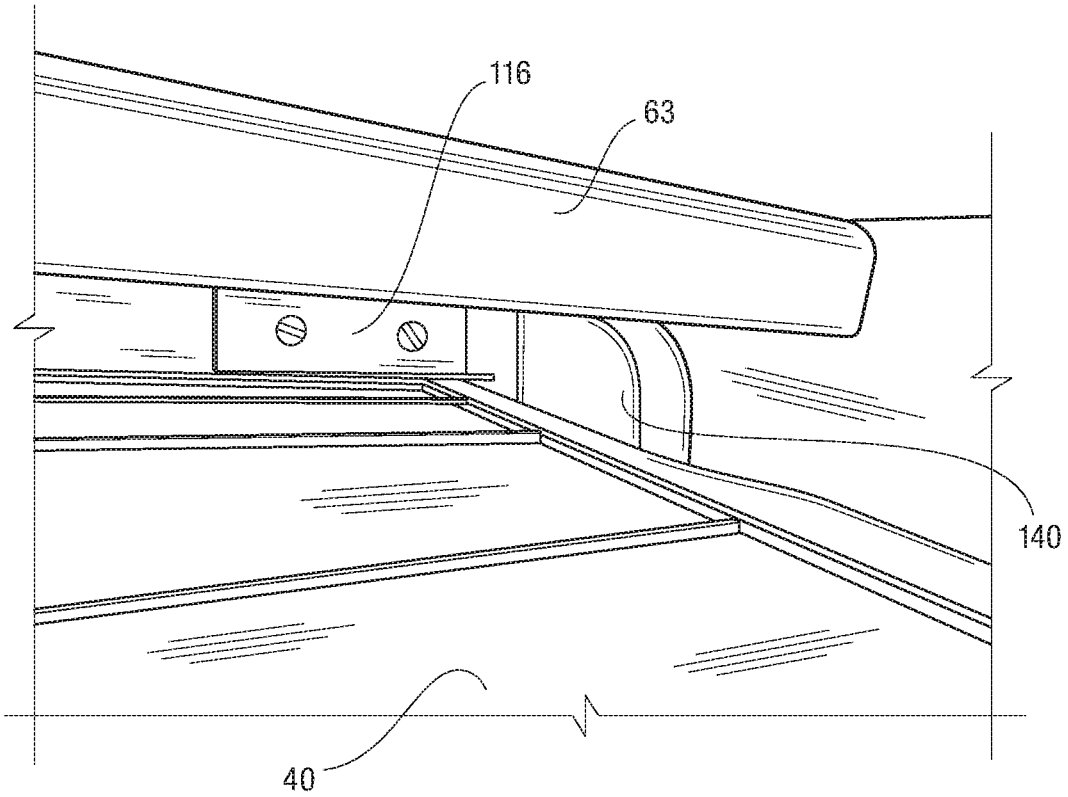
FIG. 5 is a front perspective view of the FIG. 4 top side wall brace overlying the upper surface of the docking arm as shown in FIG. 3.

As best shown in FIGS. 3 and 5, the wall mounting system 100 includes a docking arm 140 secured to the top bar 126 of the notched frame 122, between the frame 122 and the air conditioner 40 at a position on the notched frame 122 opposite to the position of the at least one hinge 132 that is between the enclosure 50 and the notched frame 122. As shown in FIG. 3, the docking arm 140 extends away from the wall 104 a distance beyond a front face 142 of the notched frame 122. The docking arm 140 includes an upper surface 144 having a docking catch 146 positioned in the upper surface 144 of the docking arm 140. The docking catch 146 is configured to engage an enclosure catch 148 (shown in FIG. 4) within a bottom surface 148 of the top side wall brace 63 of the enclosure 50. The docking catch 146 is positioned adjacent one of the first and second side walls 56, 60. The top side wall brace 63 is configured to overlie and rest upon the upper surface 144 of the docking arm 140 when the docking catch 144 engages the enclosure catch 148. The docking arm 140 thereby prevents any sagging of the enclosure 50 on the hinge 132 away from a proper alignment with the notched frame 122 and enclosed air conditioner 40.

The docking catch 144 may be either a rounded protrusion 144 or a rounded depression 144. Similarly, the enclosure catch 148 may be either a rounded depression 148 or a rounded protrusion 148, such as the head of a thumb tack 148. The rounded protrusion or depression of the docking catch 144 is configured to mate with the rounded protrusion or depression of the enclosure catch 148 to thereby provide limited resistance to movement of the enclosure catch 148 and enclosure 50 away from the docking catch 144 and mounting system 100. It is to be understood that while the rounded protrusions and depressions 144, 148 provide limited resistance for pivoting open the enclosure 50, the docking and enclosure catches 144, 148, for purposes herein, are to be understood to also include any catch means for temporarily securing the enclosure 50 to the docking arm 140, such as a sliding bar latch (not shown), a hook and eye fastener (not shown), "VELCRO" brand hook and loop adhesive fasteners, magnets, and any catch or latch mechanisms known in the art that can accomplish the described function.

In a specific embodiment of the aesthetic altering enclosure, the display surface 80 of the aesthetic panel 52 displays a wood-grain appearance, and the first and second side walls 56, 60 also display wood-grain surfaces. In a preferred embodiment of the aesthetic altering enclosure 50, the aesthetic panel 52 and the first and second side walls 56, 60 are made of solid wood.

While the present disclosure has been presented above with respect to the described and illustrated embodiments of the aesthetic altering enclosure 50, it is to be understood that the disclosure is not to be limited to those alternatives and described embodiments. Accordingly, reference should be made primarily to the following claims rather than the forgoing description to determine the scope of the disclosure.

What is claimed is:

1. An aesthetic altering enclosure for a ductless, wall-mounted air conditioner, the enclosure comprising:

a. a rectangular-shaped aesthetic panel extending between a front edge of a first side wall and a front edge of an opposed second side wall, wherein the side walls are about parallel to each other and extend away from a back side of the aesthetic panel, a top side wall brace extending between a back top corner of the first side wall to a back top corner of the second side wall, a bottom side wall brace extending between a back bottom corner of the first side wall to a back bottom corner of the second side wall wherein a void is defined between the side walls, the top side wall brace, bottom side wall brace and the back side of the aesthetic panel, so that an uninterrupted top air inlet into the void is defined between a top edge of the aesthetic panel, top edges of the opposed side walls and the top side wall brace, the aesthetic panel defining a display surface overlying a front surface of the panel;

b. a curvilinear bottom section of the aesthetic panel that corresponds with curvilinear bottom sections of the opposed side walls, wherein front edges of the side walls curve away from the aesthetic panel in a direction away from the back side of the aesthetic panel toward the bottom side wall brace; and, c. wherein the curvilinear bottom section of the aesthetic panel includes a plurality of louvres extending in parallel association between the opposed, curvilinear sections adjacent the front edges of the side walls, the louvres being spaced apart from each other to define a plurality of separate void passages between the louvres, and the plurality of void passages being dimensioned so that between about thirty percent and about seventy percent of an area of the curvilinear section of the aesthetic panel is void to define a bottom air outlet of the enclosure.

2. The aesthetic altering enclosure for the ductless, wall-mounted air conditioner of claim 1, wherein the plurality of louvres are dowel-shaped louvres.

3. The aesthetic altering enclosure for the ductless, wall-mounted air conditioner of claim 1, further including a wall-mounting system pivotally secured to the enclosure, the wall-mounting system comprising:

a. a horizontal mounting bar configured to be securely attached to the vertical wall, the mounting bar having a back side adjacent the wall and an opposed front side, the front side including a first edge plate secured to the front side adjacent a first end of the bar and including a first plate-lip extending above a top edge and the front face of the mounting bar, and the bar also including a second edge plate secured to the front side adjacent a second edge of the bar, opposed to the first end of the bar, the second edge plate including a second plate-lip extending above a top edge and the front face of the mounting bar;

b. a notched frame secured to the wall surrounding the air conditioner, the notched frame configured to define a rectangular opening dimensioned to surround the wall-mounted air conditioner and be positioned adjacent the air conditioner and, a top bar of the notched frame including a first notch-sleeve defined and configured to receive and secure the first plate-lip of the mounting bar within the first notch-sleeve, and the top bar defining a second notch-sleeve defined and configured to receive and secure the second plate-lip of the mounting bar within the second notch-sleeve; and, c. at least one hinge secured to the notched frame and to the enclosure and configured to permit the enclosure to pivot about the hinge from adjacent the notched frame and enclosing the air conditioner to away from the air conditioner to permit servicing of the air conditioner.

4. The aesthetic altering enclosure for the ductless, wall-mounted air conditioner of claim 3, further comprising a docking arm secured to the notched frame between the frame and the air conditioner at a position on the notched frame opposite to the position of the at least one hinge, the docking arm extending away from the wall a distance beyond a front face of the notched frame, the docking arm including an upper surface having a docking catch positioned in the upper surface and configured to engage an enclosure catch within a bottom surface of the top side wall brace adjacent one of the first and second side walls of the enclosure, the top side wall brace being configured to overlie and rest upon the upper surface of the docking arm when the docking catch engages the enclosure catch.

5. The aesthetic altering enclosure for the ductless, wall-mounted air conditioner of claim 4, wherein the docking catch is one of a rounded protrusion and a rounded depression, and the enclosure catch is one of a rounded protrusion and a rounded depression, wherein the rounded protrusion is configured to mate with the rounded depression to provide limited resistance to movement of the enclosure catch away from the docking catch.

6. The aesthetic altering enclosure for the ductless, wall-mounted air conditioner of claim 1, wherein the display surface of the aesthetic panel displays a wood-grain appearance, and wherein the first and second side walls display wood-grain appearances.

7. The aesthetic altering enclosure for the ductless, wall-mounted air conditioner of claim 1, wherein the aesthetic panel, the first and second side walls, and the louvres are made of solid wood.

* * * * *